US010166488B1

(12) United States Patent
Hung

(10) Patent No.: US 10,166,488 B1
(45) Date of Patent: Jan. 1, 2019

(54) DEVICE CAPABLE OF ENABLING BALLOON TO STAND UP

(71) Applicant: Chia-Wen Hung, Taipei (TW)

(72) Inventor: Chia-Wen Hung, Taipei (TW)

( * ) Notice: Subject to any disclaimer, the term of this patent is extended or adjusted under 35 U.S.C. 154(b) by 0 days.

(21) Appl. No.: 16/013,235

(22) Filed: Jun. 20, 2018

(51) Int. Cl.
*A63H 27/10* (2006.01)

(52) U.S. Cl.
CPC ..... *A63H 27/10* (2013.01); *A63H 2027/1008* (2013.01); *A63H 2027/1041* (2013.01)

(58) Field of Classification Search
CPC ..... A63H 27/10; A63H 2027/1008; A63H 2027/1041
See application file for complete search history.

(56) References Cited

U.S. PATENT DOCUMENTS 3,366,999 A * 2/1968 Darby ..... A63H 27/10 24/570
4,145,838 A * 3/1979 Mason ..... A63H 27/10 40/214
4,881,916 A * 11/1989 Houser ..... A63H 27/10 446/222
6,358,110 B1 * 3/2002 Apsner ..... A63H 27/10 446/220
D598,322 S * 8/2009 Kunz ..... D11/147
9,089,784 B2 * 7/2015 Nelson ..... A63H 27/10
9,919,828 B2 * 3/2018 Rhinerson ..... A63H 27/10
2014/0284436 A1 * 9/2014 Erwin ..... A47F 7/0028 248/176.1

* cited by examiner

*Primary Examiner* — Anita M King
(74) *Attorney, Agent, or Firm* — Muncy, Geissler, Olds & Lowe, P.C.

(57) ABSTRACT

A device capable of enabling a balloon to stand up includes a balloon and a base stand. The base stand has a stand body being a hollow semi-circular structure having an upward-facing opening, and the stand body has a first prop, multiple second props and at least a couple of fixing plates provided therein. The stand body can have an inflated balloon attached thereto by using the fastening groove on an upper end of the first prop, so as to place a protruding end of an outlet of the balloon in the clamping groove between the two fixing plates, that is, to combine the balloon with the opening end of the stand body, thus enabling the balloon to stand up stably.

4 Claims, 7 Drawing Sheets

DEVICE CAPABLE OF ENABLING BALLOON TO STAND UP

BACKGROUND OF THE INVENTION a) Field of the Invention

The present invention provides a device capable of enabling a balloon to stand up, and in particular to a device capable of enabling a balloon to be combined with an opening end of a base stand so as to keep the balloon in a stable stand-up state, which significantly increases the variation in use for the balloon and expand the commercial application of the balloon, and belongs to the technical scope of an improved balloon device.

b) Description of the Prior Art

A balloon is generally filled with ordinary air, helium or hydrogen so as to form a sphere which is light in weight. For instance, the balloon filled with helium or hydrogen can be sealed and then allowed to float in the air by using a string, and a balloon like this is most commonly applied to a toy for children. No matter the balloon is presented as a single balloon or as multiple balloons in combination, the floating effect persists and could lead to accidental loss of the balloon if the balloon is left to float carelessly.

Some of the balloons have patterns printed on their outer surfaces, such as faces of cartoon characters, and the outlets of the balloons are connected to a sealing sleeve and a holding rod so as to enable the balloons to be held by hand, which are also common. Further, in some other occasions, balloons having special shapes or multiple balloons having different shapes are combined together, and are widely applied to applications including scene arrangements, venue decorations and commercial advertisements.

From the traditional applications of balloons described above, it can be known that the floating balloons are filled with a gas lighter than the air, and the balloons having special shapes are made by employing a production technology or by having a specialized person to combine together multiple balloons having different shapes in order to construct more complex and varied shapes; no other more interesting applications have been proposed apart from the described applications.

SUMMARY OF THE INVENTION

To provide further commercial applications, the present invention provides a device capable of enabling a balloon to stand up.

That is, the primary objective of the present invention is to provide a device capable of enabling a balloon to stand up which enables a balloon to be quickly combined with a base stand so as to enable the balloon to stand up stably, and significantly increase the variation in using the balloon as a toy in a game.

A further objective of the present invention is to provide a device capable of enabling a balloon to stand up which enables multiple balloons having different shapes to be combined on a base stand to form a standing blossom of balloons, thus expanding the commercial application of balloons.

To achieve the aforesaid objectives, the present invention utilizes the following technical means.

The present invention proposes a device capable of enabling a balloon to stand up, which is comprised of at least one balloon and a base stand.

The base stand has a stand body being a hollow semi-circular structure having an upward-facing opening, and the stand body has a first prop, multiple second props and at least a couple of fixing plates integrally connected and provided therein.

The first prop is vertically provided, in an upward-facing manner, in a central position on a bottom-most edge surface in an inner portion of the stand body; a fastening groove is provided on a lateral side of an axial hole of the prop.

The multiple second props are also provided vertically and in an upward-facing manner on an inner edge surface of the stand body, and are surroundingly disposed around the first prop at equal distances.

The two fixing plates are provided on an inner edge surface of the stand body and lateral to the first prop, that is, between the first prop and the second props; a gap is provided between the two fixing plates so as to form a clamping groove.

The base stand can be made from any materials, and the most preferable material is, for example, a thermoplastic plastic material, and a weight of the base stand after forming is greater than that of a lightweight balloon.

When a balloon is combined with the base stand, a protruding end of an outlet of an inflated balloon is placed into the clamping groove by using the fastening groove on the first prop and the clamping groove between the two fixing plates. The two fixing plates press against the protruding end of the outlet of the balloon, and an elastic sphere of the balloon is clasped with the fastening groove of the first prop to enable the balloon to be protruded and extended upwards and outwards from an axial hole of the first prop, and thus completing the assembly.

The sphere of the balloon combined with the base stand is in tight contact with an opening of the stand body of the balloon base, and because the protruding end of the outlet of the balloon is clamped and pressed against the clamping groove between the two fixing plates and clasped with the fastening groove of the first prop, the base stand and the balloon will not be loosened and separated easily, and the weight of the base stand enables the balloon to stand up stably.

The balloon combined with the base stand is in a stand-up state because the weight of the base stand enables the stand body and the balloon to remain stationary, or when there is wind or an external force pushing the base stand, the balloon will drive the base stand to swing along with the wind or the external force, and then resume the stationary stand-up state.

The base stand of the present invention can also be used in combination with a balloon connected to the traditional sealing sleeve and holding rod, so as to form different arrangements of the balloon to increase the variation in arranging the balloon.

For instance, a balloon sealed with the traditional sealing sleeve can have the sealing sleeve directly inserted into the axial hole of the first prop on the inner edge of the base stand, such that the balloon is combined with the base stand.

Alternatively, multiple balloons connected to the traditional sealing sleeves and holding rods can have each of the holding rods respectively inserted into the axial hole of each of the second props on the inner edge of the base stand, such that the multiple balloons are combined with the base stand.

In the combinations of multiple balloons combined with the base stand described above, if the rod of each of the balloons has a different length, a blossom of balloons can be formed accordingly.

The device of the present invention has obvious advantages and can be used to assemble various balloons having different colors and shapes on a semi-circular base stand conveniently and quickly after the balloons are inflated, such that the balloons are enabled to stand up stably. It can be replaced with different balloons at any time, and thus is most suitably applied to a toy for children or a welcoming mascot of stores. Various combinations of balloons can be selected and used in scene arrangements, venue decorations and commercial advertisements, thus increasing the variation in the application of balloons and achieving the aforesaid objectives of the present invention. In actual use, an inner portion of the hollow stand body of the base stand of the present invention is preserved with sufficient space in design, and can be filled with certain heavy objects when necessary to increase an overall weight thereof, so as to keep the standing balloons more stable in a swinging motion.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
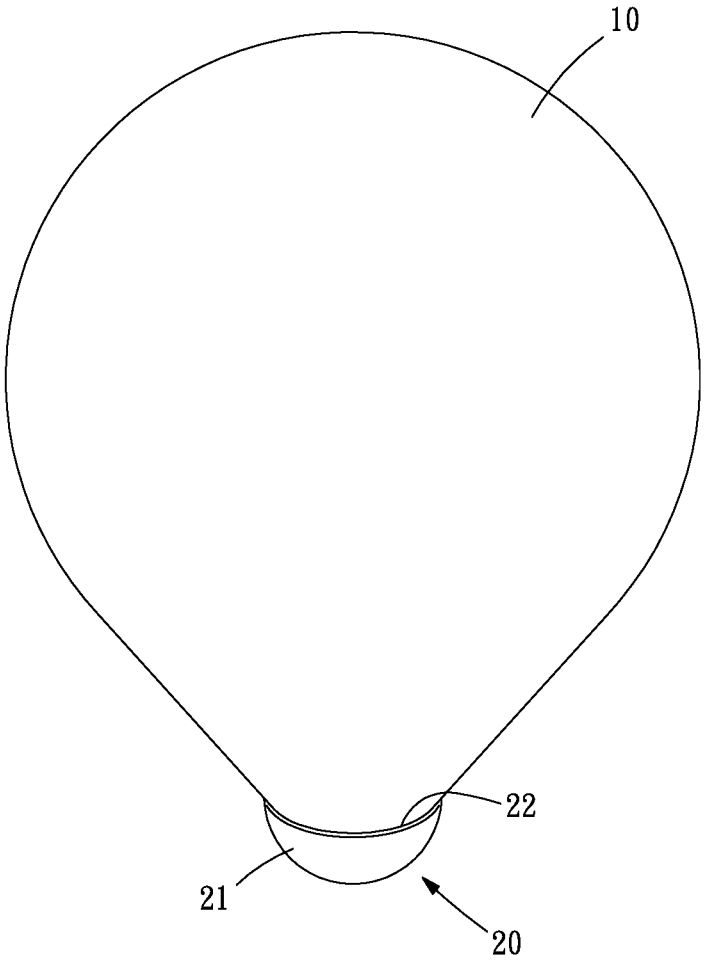
FIG. 1 is a stereoscopic external view of a device capable of enabling a balloon to stand up in accordance with the present invention.

Referring to FIG. 1, the present invention discloses a device capable of enabling a balloon to stand up, which is comprised of at least one balloon 10 and a base stand 20.

Figure 2:
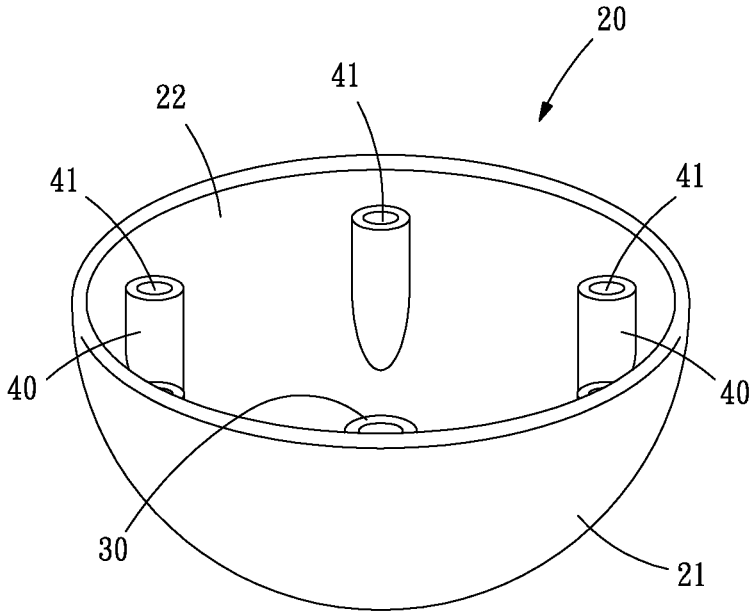
FIG. 2 is an enlarged view showing the base stand in FIG. 1.
Figure 3:
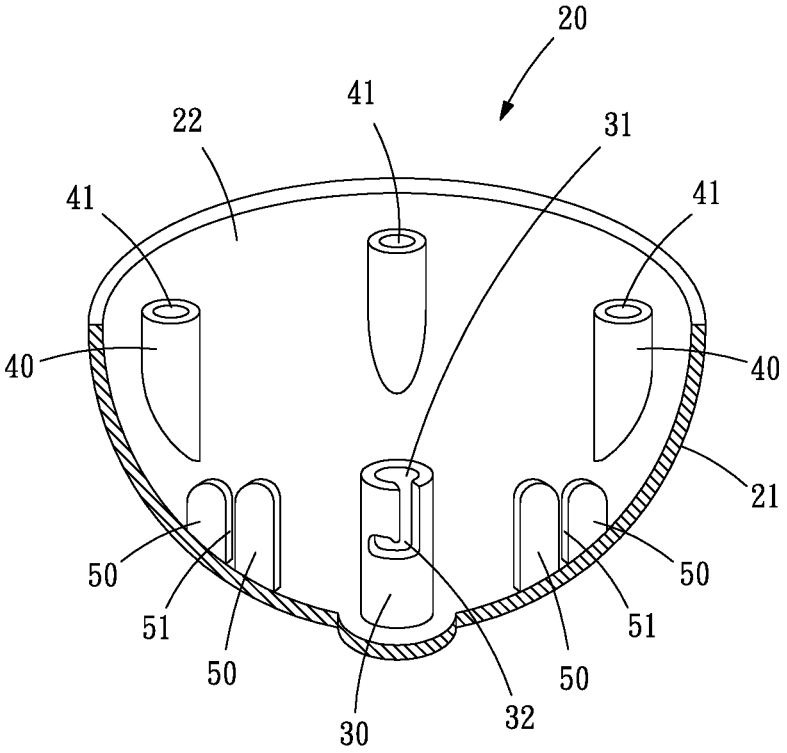
FIG. 3 is a dissected view showing the stand body of the base stand in FIG. 2.

Referring to FIGS. 2 and 3, the base stand 20 has a stand body 21 being a hollow semi-circular structure having an upward-facing opening 22, and the stand body 21 has a first prop 30, multiple second props 40 and at least a couple of fixing plates 50 integrally connected and provided therein.

Referring to FIG. 3, the first prop 30 is vertically provided, in an upward-facing manner, in a central position on a bottom-most edge surface in an inner portion of the stand body 21; a fastening groove 32 is provided on a lateral side of an axial hole 31 of the prop 30.

The fastening groove 32 is preferably designed to be L-shaped, as indicated in FIG. 3, or other shapes facilitating fastening, so as to conveniently attach a sphere of the balloon.

As shown in FIGS. 2 and 3, the multiple second props 40 are also provided vertically and in an upward-facing manner on an inner edge surface of the stand body 21, and are surroundingly disposed around the first prop 30 at equal distances.

Again, as shown in FIG. 3, the two fixing plates 50 are provided on the inner edge surface of the stand body 21 and lateral to the first prop 30, that is, between the first prop 30 ad the second props 40; a gap is provided between the two fixing plates 50 so as to form a clamping groove 51.

The base stand 20 can be made from any materials, and the most preferable material is, for example, a thermoplastic plastic material, and a weight of the base stand 20 after forming is greater than that of a lightweight balloon.

Figure 4:
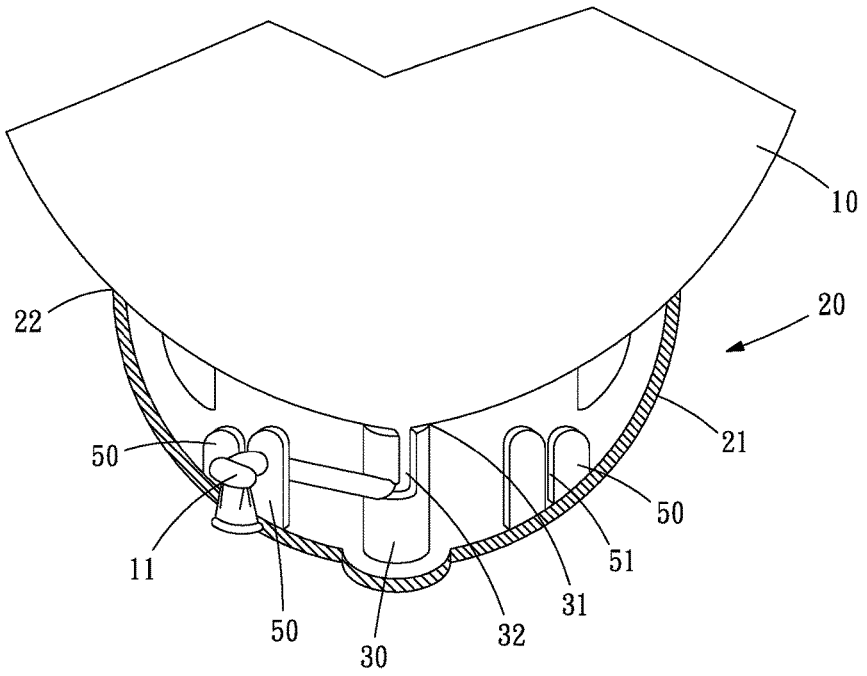
FIG. 4 is a perspective view showing that a balloon is attached by using the fixing plates and the fastening groove together in accordance with the present invention.

As indicated in FIG. 4, when the balloon 10 is combined with the base stand 20, a protruding end 11 of an outlet of an inflated balloon 10 is placed into the clamping groove 51 by using the fastening groove 32 on the first prop 30 and the clamping groove 51 between the two fixing plates 50, such that the protruding end 11 of the outlet is located on a side with the clamping groove 51; the two fixing plates 50 press against the protruding end 11 of the outlet of the balloon, and an elastic sphere of the balloon 10 is clasped with the fastening groove 32 of the first prop 30 to enable the balloon to be protruded and extended upwards and outwards from an axial hole 31 of the first prop 30, and thus completing the assembly.

The balloon 10 combined with the base stand 20 is shown in FIG. 4, in which the sphere of the balloon is in tight contact with an opening 22 of the stand body of the balloon base 20, and because the protruding end 11 of the outlet of the balloon 10 is clamped and pressed against the clamping groove 51 between the two fixing plates 50 and clasped with the fastening groove 32 of the first prop 30, the balloon 10 and the base stand 20 will not be loosened and separated easily, and a weight of the base stand 20 enables the balloon 10 to stand up stably, as indicated in FIG. 1.

The balloon 10 combined with the base stand 20 is in a stand-up state because the weight of the base stand 20 enables the stand body 21 and the balloon 10 to remain stationary, or when there is wind or an external force pushing the balloon, the balloon 10 will drive the base stand 20 to swing along with the wind or the external force, and then resume the stationary stand-up state.

Figure 6:
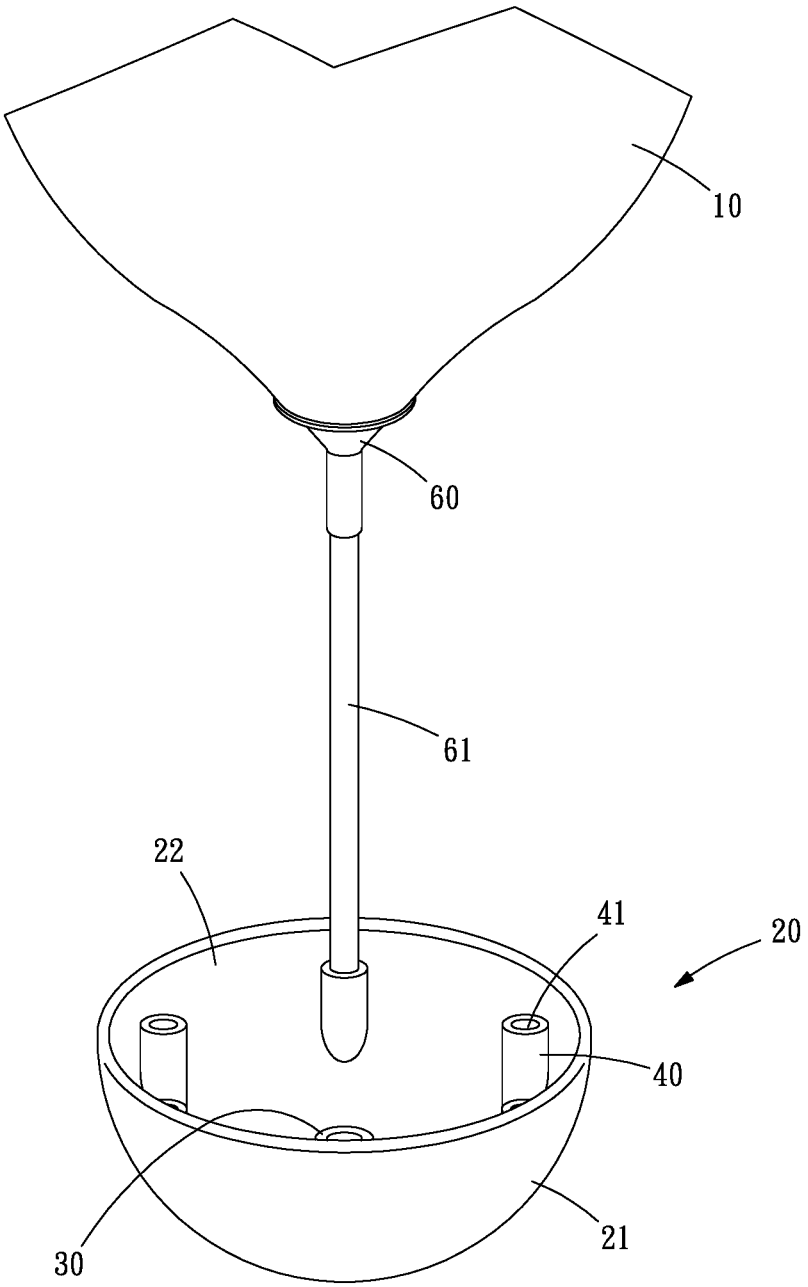
FIG. 6 is a perspective view showing the combination between the base stand and the traditional balloon holding rod in accordance with the present invention.

The base stand 20 of the present invention can also be used in combination with the balloon 10 connected to a traditional sealing sleeve 60 and a holding rod 61 (as shown in FIG. 6), so as to form different arrangements of balloon to increase the variation in arranging the balloon.

Figure 5:
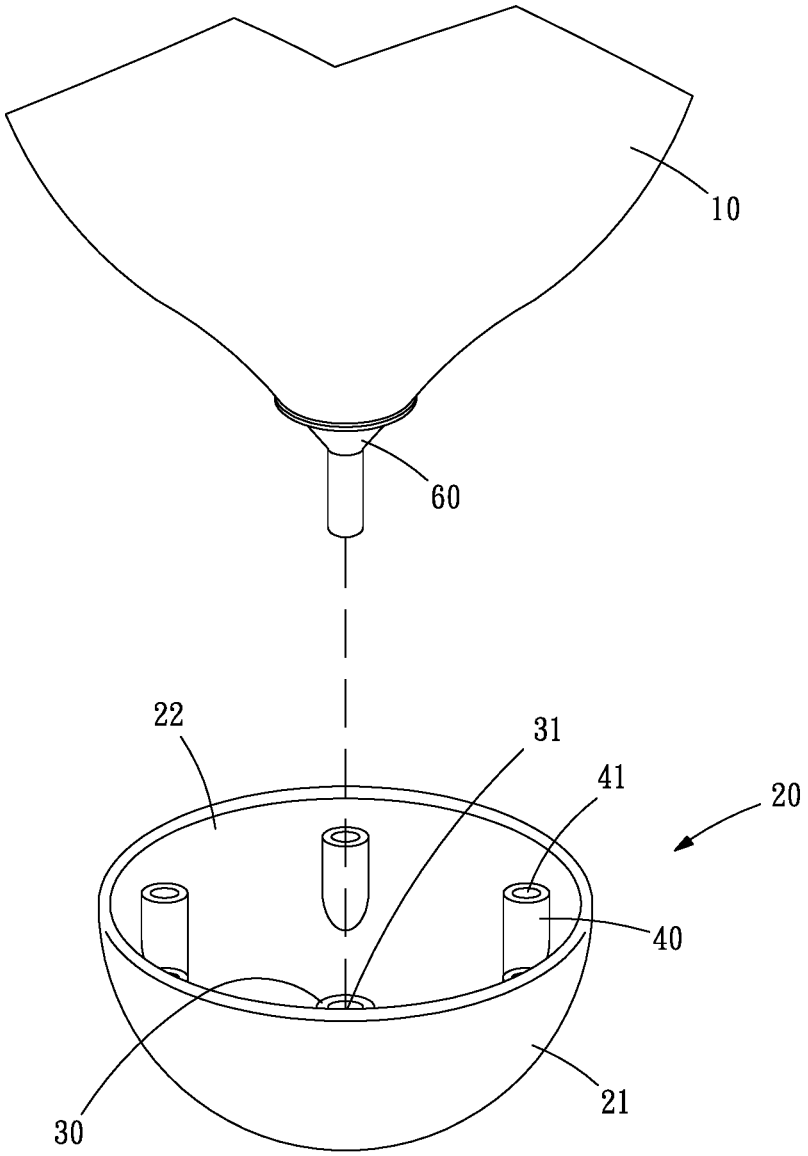
FIG. 5 is a perspective view showing the combination between the base stand and the traditional balloon sealing sleeve in accordance with the present invention.

As shown in FIG. 5, the balloon 10 sealed with the traditional sealing sleeve 60 can have the sealing sleeve 60 directly inserted into the axial hole 31 of the first prop 30 on an inner edge of the base stand 20, such that the balloon 10 is combined with the base stand 20 and enabled to stand up stably.

Alternatively, as shown in FIG. 6, multiple balloons 10 connected to the traditional sealing sleeves 60 and the holding rods 61 can have each of the holding rods 61 respectively inserted into an axial hole 41 of each of the second props 40 on the inner edge of the base stand 20, such that the multiple balloons 10 are combined with the base stand 20 and enabled to stand up stably.

Figure 7:
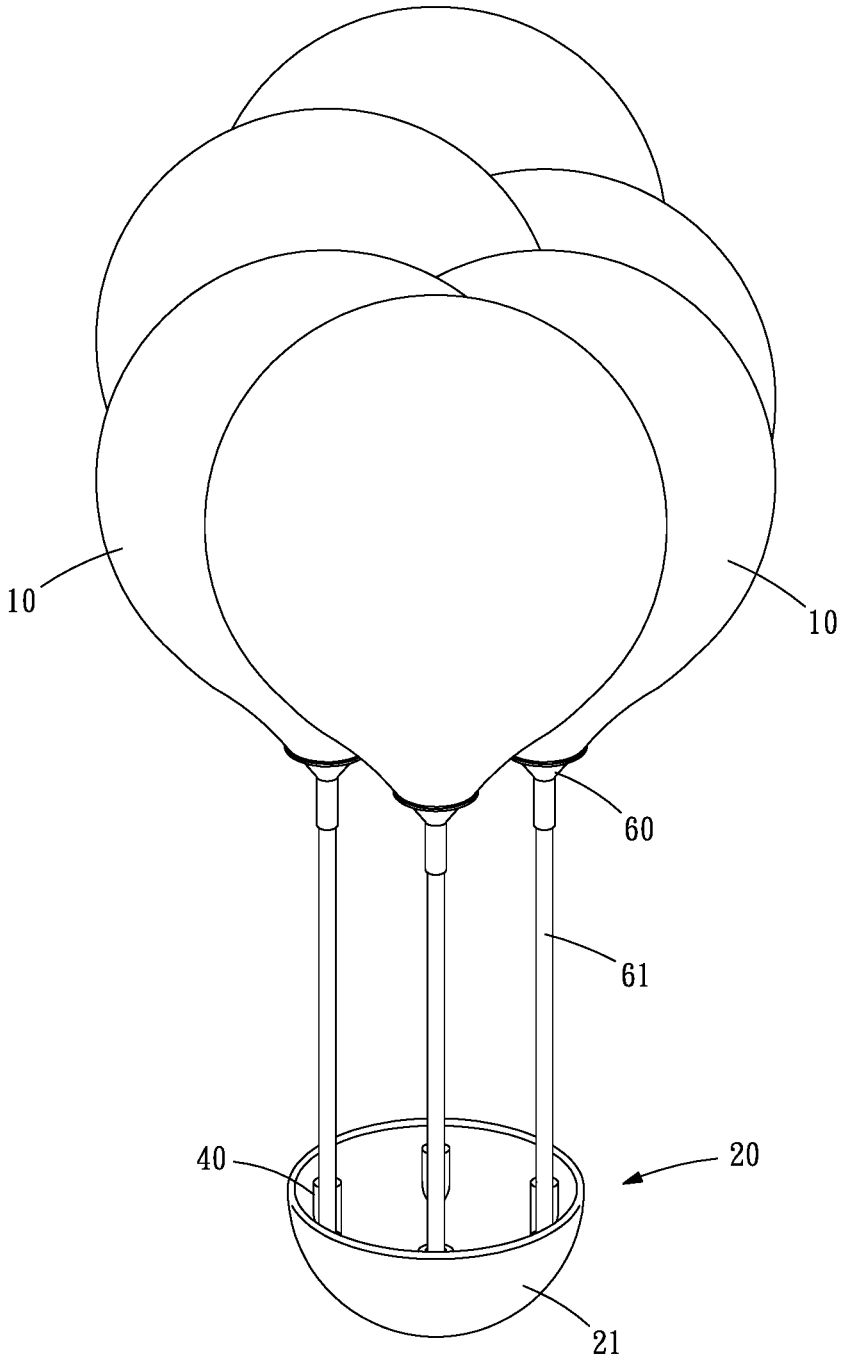
FIG. 7 is a perspective view showing that multiple balloons are combined to form a blossom of balloons on the base stand in accordance with the present invention.

In the combinations of multiple balloons 10 combined with the base stand 20 described above, if the rod 61 of each of the balloons 10 has a different length, a blossom of balloons can be formed as that shown in FIG. 7.

The device of the present invention has obvious advantages and can be used to assemble various balloons 10 having different colors and shapes on a semi-circular base stand 20 conveniently and quickly after the balloons are inflated, such that the balloons are enabled to stand up stably. It can be replaced with different balloons at any time, and thus is most adequately applied to a toy for children or a welcoming mascot of stores. Various combinations of balloons can be selected and combined to form blossoms of balloons having different appearances, and used in scene arrangements, venue decorations and commercial advertisements, thus increasing the variation in the application of balloons and achieving the aforesaid objectives of the present invention.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A device capable of enabling a balloon to stand up, comprising:

a balloon; and a base stand including a hollow semi-circular stand body having an upward-facing opening, the stand body having a first prop and at least a couple of fixing plates integrally connected and provided therein, the first prop being vertically provided, in an upward-facing manner, in a central position on a bottom-most edge surface in an inner portion of the stand body, a fastening groove being provided on a lateral side of an axial hole, the two fixing plates being provided on an inner edge surface of the stand body and lateral to the first prop, a gap being provided between the two fixing plates so as to form a clamping groove.

2. The device capable of enabling a balloon to stand up of claim 1, wherein the base stand has multiple second props provided in the inner portion of the stand body, the multiple second props are provided vertically and in an upward-facing manner on the inner edge surface of the stand body, and are surroundingly disposed around the first prop at equal distances.

3. The device capable of enabling a balloon to stand up of claim 1, wherein the hollow inner portion of the stand body of the base stand have a heavy object placed therein to increase an overall weight thereof.

4. The device capable of enabling a balloon to stand up of claim 2, wherein the hollow inner portion of the stand body of the base stand have a heavy object placed therein to increase an overall weight thereof.

* * * * *